United States Patent [19]

Pinkney

[11] Patent Number: 5,069,134

[45] Date of Patent: Dec. 3, 1991

[54] FLAMELESS EXPULSION GRENADE

[75] Inventor: Barry D. Pinkney, Jefferson, Ohio

[73] Assignee: Def-Tec Corporation, Rock Creek, Ohio

[21] Appl. No.: 535,466

[22] Filed: Jun. 8, 1990

[51] Int. Cl.[5] ..... F42B 12/46

[52] U.S. Cl. ..... 102/368; 102/498

[58] Field of Search ..... 102/368, 367, 369, 370, 102/372, 431, 373, 481, 486, 482; 222/5, 635

[56] References Cited

U.S. PATENT DOCUMENTS

| | | | |
|---|---|---|---|
| 1,659,158 | 2/1928 | Oglesby et al. | 102/368 |
| 2,562,928 | 8/1951 | Lewis | 102/368 |
| 3,117,521 | 1/1964 | Reaves | 102/368 |
| 3,188,954 | 6/1965 | Roach et al. | 102/369 |
| 3,402,665 | 9/1968 | Tarpley et al. | 102/368 |
| 3,512,480 | 5/1970 | Barr | 102/368 |
| 3,731,632 | 5/1973 | Stevens | 102/482 |
| 3,785,569 | 1/1974 | Helmrich | 102/368 |
| 4,140,710 | 2/1979 | Klein | 558/401 |
| 4,690,061 | 9/1987 | Armer et al. | 102/367 |
| 4,932,328 | 6/1990 | Pinkney et al. | 102/368 |
| 4,944,521 | 7/1990 | Greeno | 102/498 |

*Primary Examiner*—David H. Brown

*Attorney, Agent, or Firm*—Renner, Otto, Boisselle & Sklar

[57] ABSTRACT

A flameless tear gas grenade characterized by a container containing a powdered agent and having container outlets, a cartridge filled with pressurized gas positioned within the container, and a releasing mechanism for releasing the pressurized gas from the cartridge to expel the powdered agent out through the container outlets.

27 Claims, 1 Drawing Sheet

FLAMELESS EXPULSION GRENADE

FIELD OF THE INVENTION

This invention relates generally to a flameless expulsion grenade intended for use by trained law enforcement personnel in prisons, swat operations, drug raids and other law enforcement activities. When activated, the grenade expels a tear gas-like powder which temporarily incapacitates those persons affected. Tear gas will typically cause the affected persons' eyes to tear and swell and will generally disorient the affected persons for a sufficient length of time to give the law enforcement personnel a significant advantage over those affected.

BACKGROUND OF THE INVENTION

Tear gas grenades of the flammable or pyrotechnic type have been in use for some time. Pyrotechnic grenades include a fuel used to ignite tear gas pellets which produce a smoke that is expelled through ports in the grenades. A major drawback in using pyrotechnic grenades is that they burn quite hot and can readily start fires. Accordingly, their use is generally limited to locations where there is no fear of igniting combustible materials such as outdoors and in areas in prisons where there is primarily concrete.

A need therefore remains for a flameless tear gas grenade for use indoors or anywhere there are combustible materials present without any danger of causing a fire.

SUMMARY OF THE INVENTION

With the foregoing in mind, it is a principal object of this invention to provide a tear gas grenade which is completely flameless, whereby it may be used indoors or anywhere combustible materials are present without any danger of causing a fire.

Another object is to provide a flameless tear gas grenade which is much more stable than previous known pyrotechnic type tear gas grenades.

Still another object is to provide a flameless tear gas grenade which satisfies safety concerns, and is relatively inexpensive to manufacture.

These and other objects of the present invention may be achieved by providing a flameless tear gas grenade including a container for a powdered agent, a cartridge filled with pressurized gas positioned within the container, and a releasing mechanism for releasing the pressurized gas from the cartridge in order to expel the powdered agent out through one or more ports in the container.

To the accomplishment of the foregoing and related ends, the invention, then, comprises the features hereinafter fully described and particularly pointed out in the claims, the following description and annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
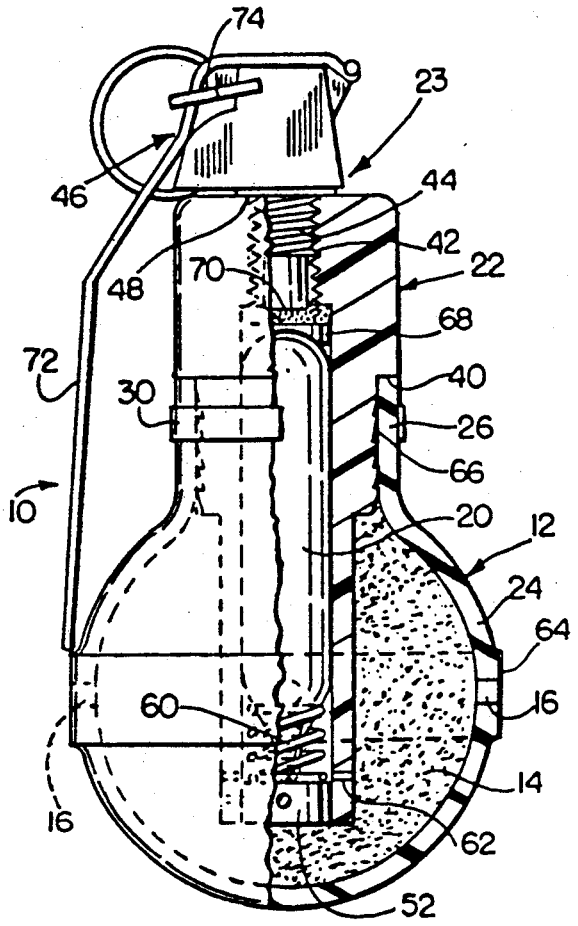
FIG. 1 is a side elevation view, partly in section, of a preferred form of flameless tear gas grenade according to the present invention.

Referring now in detail to the drawing, and initially to FIG. 1, a preferred form of a flameless tear gas grenade according to the present invention is indicated generally at 10. The grenade 10 includes a container 12 containing a powdered agent 14 and having container outlet ports 16. A cartridge 20 filled with pressurized gas, preferably carbon dioxide ($CO_2$), is positioned within the container 12. The cartridge 20 is mounted within a grenade stem 22 that also contains a releasing mechanism 23 for releasing the pressurized gas from the cartridge 20. When the pressurized gas is released, it serves to expel the powdered agent 14 through the container outlet ports 16 in a manner to be more fully described hereafter.

The shape and size of the container 12 may vary, but desirably includes a spherical portion 24 to aid in the expulsion of the powdered agent 14 from the container, and a cylindrical portion 26 dimensioned to receive the grenade stem 22. Preferably, container 12 is of a size that fits comfortably into the palm of a user's hand. In a preferred embodiment, the container 12 has an outer diameter of approximately 3 inches and a wall thickness of approximately 0.125 inch. Also, the cylindrical portion 26 has an overall height of approximately 0.900 inch, an outer diameter of approximately 1.670 inches, and an inner diameter of approximately 1.420 inches.

Figure 3:
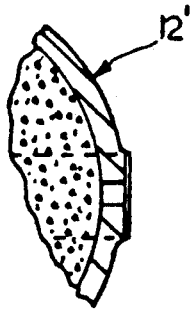
FIG. 3 is a fragmentary section view through the container portion of another form of flameless tear gas grenade according to this invention which is substantially identical to that shown in FIG. 1 except that the container is made out of metal instead of rubber.
Figure 2:
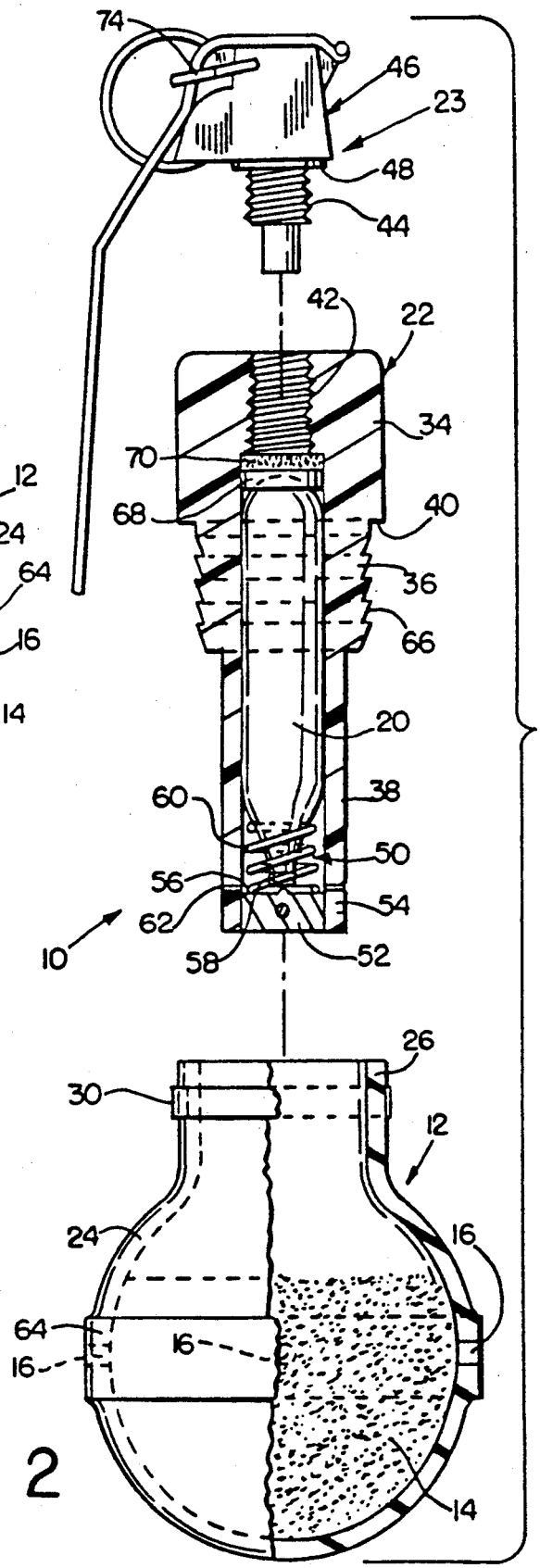
FIG. 2 is an exploded side elevation view, partly in section, of the flameless grenade of FIG. 1 including a fuse assembly shown in elevation, a grenade stem shown in section, and a container filled with a tear gas agent shown partly in section.

The container 12 is preferably made of rubber for ease of fabrication as by injection molding. The grenade stem 22 extends part way into the container 12 through the cylindrical portion 26 and is secured thereto as by means of a band 30. Alternatively, the container 12 may be made of other materials such as Bakelite or metal including particularly aluminum or steel schematically shown in FIG. 3. If made of metal, the container 12 could be made by stamping two container parts or halves and joining them together using a standard roll seam.

An advantage in making the container 12 out of metal is that it allows the grenade to be more readily thrown through a window or screen using a grenade launcher attached to a shotgun or rifle or the like. If the container 12 is made of metal, mating threads would ordinarily be provided between the container 12 and grenade stem 22 to secure these parts together in lieu of the band 30.

A disadvantage in using a metal container is that tear gas is known to corrode certain types of metals, which could reduce the shelf life of the grenade. However, this corrosion problem could be minimized as by providing a protective coating on the inside of the container 12 and/or by using a metal such as aluminum.

The powdered agent 14 that is used within the container 12 is preferably a micropulverized tear gas powder mixture. The term micropulverized as used herein refers to particles broken down to micro size particles which are much finer than the standard powders used in a pyrotechnic tear gas grenade. In the preferred embodiment disclosed herein, the mechanical mix of the agent 14 comprises approximately 50 to 70% of a carrier such as magnesium oxide, approximately 10% of a flow agent such as hydrophobic fumed silica, and approximately 20 to 40% tear gas (CS or CN). If more than 40% of the agent is tear gas, the agent would likely be much too strong and very costly. The ingredients are all mixed together and then passed through a sieve (preferably a No. 80 sieve), after which the ingredients are mixed a second time. If the powdered agent 14 is not fine enough, it will not have sufficient flowability to achieve the required velocity in order to flow out of the container through the outlet ports 16 when pressurized gas is released in the container as described hereafter.

Turning now to the details of the grenade stem 22, such stem is desirably externally stepped as shown to provide a larger diameter upper portion 34, a somewhat smaller diameter intermediate portion 36 and a still smaller diameter lower portion 38. Between the upper and intermediate portions 34, 36 is a radial stop surface or shoulder 40. Extending coaxially through the upper portion 34 is a threaded bore 42 for threaded receipt of an adaptor 44 of a fuse member 46, along with a gasket 48. Extending coaxially through the smaller diameter portions 36 and 38 and into the lower part of the upper portion 34 in coaxial alignment with the fuse bore 42 is a cartridge chamber 50 which contains the pressurized gas cartridge 20.

The cartridge 20 is retained within the cartridge chamber 50 by means of a punch 52 pinned or otherwise secured in the bottom end 54 of the grenade stem 22. On the inner (upper) face 56 of the punch 52 is a piercing point 58 for piercing the gas cartridge 20 in a manner to be subsequently described. The gas cartridge 20 is normally maintained out of engagement with the piercing point 58 by means of a coil spring 60 interposed therebetween.

Immediately adjacent the inner face 56 of the punch 52 are one or more vents 62 that extend radially through the wall of the grenade stem 22 to provide for the escape of pressurized gas from the cartridge chamber 50 to the interior of the container 12 when the cartridge 20 is pierced. Preferably two such vents 62 are provided in diametrically spaced relation from each other, each having a diameter of between about 0.010 inch and 0.125 inch, with approximately 0.090 inch being preferred.

On the other hand, there are desirably four uniformly spaced outlet ports 16 through the container wall 12, each preferably made by a ¼ inch punch to provide a hole size of between 7/32 inch and ¼ inch. Tests have shown that when the holes 62 and 16 are within these specified ranges, approximately 98% of the powdered agent 14 will be expelled along with the pressurized gas, whereas if the ports are any larger or smaller than that, as much as 50 to 60% of the powdered agent will be left behind when the pressurized gas is released from the cartridge 20.

Before the powdered agent 14 is poured into the container 12, a vinyl strip 64 with a self-adhesive backing is wrapped around the middle section of the container to seal the outlet ports 16. Then a measured amount of powdered agent 14, for example, 38 grams, is poured into the container 12 through the cylindrical portion 26 and the grenade stem 22 is inserted and secured in place by crimping the band 30 tightly around the cylindrical portion forming an airtight seal. Ridges 66 may also be provided on the outer diameter of the intermediate stem portion 36 for sealing purposes. In the usual case, it has been found that if the container 12 is initially filled approximately three-quarters full of powdered agent 14, when the grenade stem 22 is inserted into the container, the powdered agent will be displaced sufficiently to substantially fill all of the voids in the container.

Before the grenade stem 22 is inserted into the container 12, the grenade stem 22 is partially preassembled with the pressurized gas cartridge 20, punch 52 and spring 60 mounted therein. Also, a fabric wad member 68 is inserted within the cartridge chamber 50 adjacent the upper end of the cartridge 20. However, the fuse member 46 is not initially included as part of the grenade stem assembly.

To complete the assembly, a predetermined amount, for example, 5 grams, of FFG black starter powder 70 is poured through the threaded bore 42 onto the wad 68 adjacent the top of the chamber 50. Then the fuse member 46 is screwed into the threaded bore 42 and glued in place to prevent tampering.

The fuse member 46 may be a standard military type fuse member including a fuse lever 72 held in place by a removable pin 74. When the pin 74 is removed and the fuse lever 72 is released, a delayed flash occurs, igniting the black powder 70, which drives the cartridge 20 downwardly into piercing engagement with the punch 52. This releases the pressurized gas which escapes through the vents 62 into the surrounding area of the container 12 and effectively disperses substantially all of the powdered agent 14 out through the outlet ports 16 and vinyl strip covering same in approximately four to five seconds.

From the foregoing, it will now be apparent that the present invention provides a flameless tear gas grenade which effectively disperses substantially all of its contents within a relatively short period of time without any danger of causing a fire. Also, the grenade is extremely stable and is relatively inexpensive to manufacture.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

What is claimed is:

1. A flameless expulsion grenade comprising a container containing a powdered agent and having container outlet means, a cartridge filled with pressurized gas positioned within said container, releasing means for releasing said pressurized gas from said cartridge to expel said powdered agent out through said container outlet means, and a grenade stem connected to said container, said grenade stem including a cartridge chamber containing said cartridge, and vent means in said grenade stem communicating said cartridge chamber with a surrounding space defined by said container for exiting said pressurized gas from said chamber into said surrounding space.

2. A flameless grenade as set forth in claim 1 wherein said container includes a spherical portion and a cylindrical portion defining an opening into said spherical portion, said cylindrical portion being dimensioned to receive said grenade stem.

3. A flameless grenade as set forth in claim 1 wherein said container is generally spherical in shape and is made of a rubber-like material.

4. A flameless grenade as set forth in claim 1 wherein said container is generally spherical in shape and is made of metal.

5. A flameless grenade as set forth in claim 1 wherein said releasing means comprises puncturing means for puncturing said cartridge.

6. A flameless grenade as set forth in claim 5 wherein said releasing means further comprises starter powder means which when ignited drives said cartridge against said puncturing means to puncture said cartridge, and fuse means for igniting said starter powder means.

7. A flameless grenade as set forth in claim 1 wherein said container has an opening through which said grenade stem extends into said container.

8. A flameless grenade as set forth in claim 7 further comprising sealing means for forming an airtight seal between said opening and said grenade stem.

9. A flameless grenade as set forth in claim 1 wherein said cartridge chamber vent means comprises a pair of diametrically opposite outlet openings in said grenade stem.

10. A flameless grenade as set forth in claim 9 wherein said outlet openings in said grenade stem have a diameter of between approximately 0.010 inch and 0.125 inch.

11. A flameless grenade as set forth in claim 1 wherein said releasing means comprises a puncture member adjacent a bottom end of said cartridge chamber, and actuation means for forcing said cartridge against said puncture member to puncture said cartridge and thereby release said pressurized gas from said cartridge.

12. A flameless grenade as set forth in claim 11 further comprising spring means for moving said cartridge away from said puncture member after said cartridge has been pierced by said puncture member.

13. A flameless grenade as set forth in claim 11 wherein said actuation means comprises starter powder adjacent a top end of said cartridge chamber.

14. A flameless grenade as set forth in claim 13 further comprising wad means for supporting said starter powder within said cartridge chamber adjacent an upper end of said cartridge.

15. A flameless grenade as set forth in claim 1 wherein said grenade stem extends part way into said container, and said vent means is located adjacent an innermost end of said grenade within said container for exiting said pressurized gas into said container when released from said cartridge.

16. A flameless grenade as set forth in claim 15 wherein said vent means comprises a pair of diametrically opposite outlet openings in said grenade stem adjacent said innermost end having a diameter of between approximately 0.010 inch and 0.125 inch.

17. A flameless grenade as set forth in claim 15 wherein said container is generally spherical in shape and has an opening through which said grenade stem extends into said container, and said container outlet means comprises a plurality of circumferentially spaced holes extending through an outer wall of said container approximately midway between said opening and a wall portion of said container directly opposite said opening.

18. A flameless grenade as set forth in claim 17 wherein there are four of said holes in said outer wall of said container each having a diameter of approximately one-quarter inch.

19. A flameless grenade as set forth in claim 18 further comprising strip means wrapped around said container in overlying relation with said holes to seal said powdered agent in said container prior to releasing said pressurized gas.

20. A flameless grenade as set forth in claim 17 wherein said powdered agent consists of a micropulverized powdered mixture of a carrier, a flow agent, and tear gas.

21. A flameless grenade as set forth in claim 20 wherein said vent means comprises a pair of diametrically opposite outlet openings in said grenade stem having a diameter of between approximately 0.010 inch and 0.125 inch, and there are four of said holes in said outer wall of said container each having a diameter of approximately one-quarter inch.

22. A flameless expulsion grenade comprising a container containing a powdered agent and having container outlet means, a cartridge filled with pressurized gas positioned within said container, said container being generally spherical in shape and having an opening through which said cartridge extends into said container, and releasing means for releasing said pressurized gas from an innermost end of said cartridge within said container to expel said powdered agent out through said container outlet means, said powdered agent consisting of a micropulverized powdered mixture of a carrier, a flow agent, and tear gas, and said container outlet means comprising a plurality of circumferentially spaced holes extending through an outer wall of said container approximately midway between said opening and a wall portion of said container directly opposite said opening.

23. A flameless grenade as set forth in claim 22 wherein said carrier comprises magnesium oxide.

24. A flameless grenade as set forth in claim 22 wherein said flow agent comprises hydrophobic fumed silica.

25. A flameless grenade as set forth in claim 22 wherein there are four of said holes in said outer wall of said container each having a diameter of approximately one-quarter inch.

26. A flameless grenade as set forth in claim 22 wherein said powdered agent consists of between approximately 50 to 70 percent of said carrier, approximately 10% of said flow agent, and between approximately 20% and 40% of said tear gas.

27. A flameless grenade as set forth in claim 26 wherein said carrier comprises magnesium oxide and said flow agent comprises hydrophobic fumed silica.

* * * * *